US011074919B2

(12) United States Patent
Moriya et al.

(10) Patent No.: US 11,074,919 B2
(45) **Date of Patent: *Jul. 27, 2021**

(54) ENCODING METHOD, DECODING METHOD, ENCODER, DECODER, PROGRAM, AND RECORDING MEDIUM

(71) Applicant: Nippon Telegraph and Telephone Corporation, Chiyoda-ku (JP)

(72) Inventors: Takehiro Moriya, Kanagawa (JP); Noboru Harada, Kanagawa (JP); Yutaka Kamamoto, Kanagawa (JP); Yusuke Hiwasaki, Tokyo (JP); Masahiro Fukui, Tokyo (JP)

(73) Assignee: Nippon Telegraph and Telephone Corporation, Chiyoda-ku (JP)

( * ) Notice: Subject to any disclaimer, the term of this patent is extended or adjusted under 35 U.S.C. 154(b) by 59 days.

This patent is subject to a terminal disclaimer.

(21) Appl. No.: 16/687,176

(22) Filed: Nov. 18, 2019

(65) Prior Publication Data

US 2020/0090665 A1 Mar. 19, 2020

Related U.S. Application Data

(63) Continuation of application No. 14/007,844, filed as application No. PCT/JP2012/057685 on Mar. 26, 2012, now Pat. No. 10,515,643.

(30) Foreign Application Priority Data

Apr. 5, 2011 (JP) ..... 2011-083740

(51) Int. Cl.
*G10L 19/02* (2013.01)
*G10L 19/008* (2013.01)
(Continued)

(52) U.S. Cl.
CPC ..... *G10L 19/005* (2013.01); *G10L 19/008* (2013.01); *G10L 19/032* (2013.01);
(Continued)

(58) Field of Classification Search
CPC ..... G10L 19/008; G10L 19/24; G10L 19/167; G10L 21/038; G10L 19/2012; G10L 19/0212
See application file for complete search history.

(56) References Cited

U.S. PATENT DOCUMENTS 5,781,561 A 7/1998 Machida
5,956,674 A 9/1999 Smyth et al.
(Continued)

FOREIGN PATENT DOCUMENTS

KR 10-2004-0065641 A 7/2004
KR 10-2007-0076519 A 7/2007
(Continued)

OTHER PUBLICATIONS

European Office Action dated May 15, 2020 in Patent Application No. 18 196 322.4, 6 pages.
(Continued)

*Primary Examiner* — Bryan S Blankenagel
(74) *Attorney, Agent, or Firm* — Oblon, McClelland, Maier & Neustadt, L.L.P.

(57) ABSTRACT

In encoding, a frequency-domain sample sequence derived from an acoustic signal is divided by a weighted envelope and is then divided by a gain, the result obtained is quantized, and each sample is variable-length encoded. The error between the sample before quantization and the sample after quantization is quantized with information saved in this variable-length encoding. This quantization is performed under a rule that specifies, according to the number of saved bits, samples whose errors are to be quantized. In decoding,
(Continued)

variable-length codes in an input sequence of codes are decoded to obtain a frequency-domain sample sequence; an error signal is further decoded under a rule that depends on the number of bits of the variable-length codes; and from the obtained sample sequence, the original sample sequence is obtained according to supplementary information.

7 Claims, 6 Drawing Sheets

(51) Int. Cl.

| | |
|---|---|
| ***G10L 19/24*** | (2013.01) |
| ***G10L 19/16*** | (2013.01) |
| ***G10L 21/038*** | (2013.01) |
| ***G10L 19/005*** | (2013.01) |
| ***G10L 19/032*** | (2013.01) |
| *G10L 19/00* | (2013.01) |
| *G10L 19/035* | (2013.01) |
| *G10L 19/038* | (2013.01) |

(52) U.S. Cl.
CPC ..... *G10L 19/167* (2013.01); *G10L 19/24* (2013.01); *G10L 21/038* (2013.01); *G10L 19/0017* (2013.01); *G10L 19/0212* (2013.01); *G10L 19/035* (2013.01); *G10L 19/038* (2013.01)

(56) References Cited

U.S. PATENT DOCUMENTS

| | | | | |
|---|---|---|---|---|
| 6,091,460 | A | 7/2000 | Hatano | |
| 7,275,036 | B2 | 9/2007 | Geiger et al. | |
| 7,668,712 | B2 | 2/2010 | Wang et al. | |
| 2002/0176353 | A1 | 11/2002 | Atlas et al. | |
| 2004/0049379 | A1 | 3/2004 | Thumpudi et al. | |
| 2004/0184537 | A1 | 9/2004 | Geiger et al. | |
| 2005/0091051 | A1 | 4/2005 | Moriya et al. | |
| 2006/0235678 | A1 | 10/2006 | Kim et al. | |
| 2007/0033494 | A1* | 2/2007 | Wenger | H04N 19/33 714/776 |
| 2007/0124141 | A1 | 5/2007 | You | |
| 2007/0143118 | A1 | 6/2007 | Chen | |
| 2008/0082325 | A1 | 4/2008 | Tsuji | |
| 2008/0292028 | A1 | 11/2008 | Oh | |
| 2009/0002207 | A1* | 1/2009 | Harada | H03M 7/3086 341/51 |
| 2009/0210234 | A1* | 8/2009 | Sung | G10L 19/18 704/500 |
| 2009/0248424 | A1 | 10/2009 | Koishida et al. | |
| 2010/0017204 | A1 | 1/2010 | Oshikiri | |
| 2010/0106511 | A1 | 4/2010 | Shirakawa et al. | |
| 2010/0191534 | A1 | 7/2010 | Ryu et al. | |
| 2010/0265111 | A1 | 10/2010 | Harada et al. | |
| 2012/0265525 | A1 | 10/2012 | Moriya | |

FOREIGN PATENT DOCUMENTS

| | | |
|---|---|---|
| KR | 10-2008-0072451 A | 8/2008 |
| WO | 2012 046685 | 4/2012 |

OTHER PUBLICATIONS

ETSI TS 126 290 V6.3.0, "Digital cellular telecommunications system (Phase 2+): Universal Mobile Telecommunications System (UMTS); Audio codec processing functions; Extended Adaptive Multi-Rate—Wideband (AMR-WB +) codec; Transcoding functions (3GPP TS 26.290 version 6.3.0 Release 6)" ETSI, pp. 1-86, (Jun. 2005).

Salomon, D., "Data Compression, The Complete Reference", Springer-Verlag, pp. 20-35 and 56-65, (2004).

International Search Report dated Jul. 3, 2012 in PCT/JP12/057685 Filed Mar. 26, 2012.

Extended European Search Report dated Oct. 10, 2014 in Patent Application No. 12767213.7.

Henrique S. Malvar, "Lossless and Near-Lossless Audio Compression Using Integer-Reversible Modulated Lapped Transforms", Data Compression Conference (DCC'07), IEEE Computer Society, XP 031073812, (Mar. 1, 2007), pp. 323-332.

Office Action dated Feb. 12, 2015 in Korean Patent Application No. 10-2013-7025380 (w/English language translation).

Office Action dated Jul. 14, 2015, in European Patent Application No. 12767213.7.

European Office Action dated Jan. 21, 2016, in Patent Application No. 12 767 213.7.

Extended European Search Report dated Feb. 16, 2017 for corresponding European Patent Divisional Application No. 16195433.4 (English).

ITU-T G.719, "Low-complexity, full-band audio coding for high-quality, conversational applications", Transmission Systems and Media, Digital Systems and Networks, Digital terminal equipment—Coding of analogue signals, Mar. 30, 2008, pp. 1-58, XP055055552, Geneva-Switzerland. Retrieved from the Internet (Mar. 6, 2006): URL:http://www.itu.int/rec/dologin_pub.asp?lang=e&id=T-REC-G.719-200806-I!!SOFT-ZST-E&type-items.

Examination Report dated Mar. 9, 2018, in corresponding Indian Patent Application No. 8381/DELNP/2013.

Extended European Search Report dated Jan. 2, 2019 in European Application No. 18196322.4.

* cited by examiner

ENCODING METHOD, DECODING METHOD, ENCODER, DECODER, PROGRAM, AND RECORDING MEDIUM

CROSS-REFERENCE TO RELATED APPLICATIONS

This application is a continuation of and claims the benefit of priority under 35 U.S.C. § 120 from U.S. application Ser. No. 14/007,844 filed Sep. 26, 2013, the entire contents of which are incorporated herein by reference. U.S. application Ser. No. 14/007,844 is a National Stage of PCT/JP2012/057685 filed Mar. 26, 2012, which claims the benefit for priority under 35 U.S.C. § 119 from Japanese Application No. 2011-083740 filed Apr. 5, 2011.

TECHNICAL FIELD

The present invention relates to a technique for encoding acoustic signals and a technique for decoding code sequences obtained by the encoding technique, and more specifically, to encoding of a frequency-domain sample sequence obtained by converting an acoustic signal into the frequency domain and decoding of the encoded sample sequence.

BACKGROUND ART

Adaptive encoding of orthogonal transform coefficients in the discrete Fourier transform (DFT), modified discrete cosine transform (MDCT), and the like is a known method of encoding speech signals and acoustic signals having a low bit rate (about 10 to 20 kbit/s, for example). A standard technique AMR-WB+ (extended adaptive multi-rate wideband), for example, has a transform coded excitation (TCX) encoding mode, in which DFT coefficients are normalized and vector-quantized in units of eight samples (refer to Non-patent literature 1, for example).

PRIOR ART LITERATURE

Non-Patent-Literature

Non-patent literature 1: ETSI TS 126 290 V6.3.0 (2005-06)

SUMMARY OF THE INVENTION

Problems to be Solved by the Invention

Since AMR-WB+ and other TCX-based encoding do not consider variations in the amplitudes of frequency-domain coefficients caused by periodicity, if amplitudes that vary greatly are encoded together, the encoding efficiency would decrease. Among a variety of modified TCX-based quantization or encoding techniques, a case will now be considered, for example, in which a sequence of MDCT coefficients arranged in ascending order of frequency, the coefficients being discrete values obtained by quantizing a signal obtained by dividing coefficients by a gain, is compressed by entropy encoding of arithmetic codes and the like. In this case, a plurality of samples form a single symbol (encoding unit), and a code to be assigned is adaptively controlled depending on the symbol immediately preceding the symbol of interest. Generally, if the amplitude is small, a short code is assigned, and if the amplitude is large, a long code is assigned. This reduces the number of bits per frame generally. If the number of bits to be assigned per frame is fixed, there is a possibility that the reduced number of bits cannot be used efficiently.

In view of this technical background, an object of the present invention is to provide encoding and decoding techniques that can improve the quality of discrete signals, especially the quality of digital speech or acoustic signals after they have been encoded at a low bit rate, with a small amount of calculation.

Means to Solve the Problems

An encoding method according to one aspect of the present invention is a method for encoding, with a predetermined number of bits, a frequency-domain sample sequence derived from an acoustic signal in a predetermined time interval. The encoding method includes an encoding step of encoding, by variable-length encoding, an integer corresponding to the value of each sample in the frequency-domain sample sequence to generate a variable-length code; an error calculation step of calculating a sequence of error values each obtained by subtracting the integer corresponding to the value of each sample in the frequency-domain sample sequence from the value of the sample; and an error encoding step of encoding the sequence of error values with the number of surplus bits obtained by subtracting the number of bits of the variable-length code from the predetermined number of bits to generate error codes.

A decoding method according to one aspect of the present invention is a method for decoding an input code formed of a predetermined number of bits. The decoding method includes a decoding step of decoding a variable-length code included in the input code to generate a sequence of integers; an error decoding step of decoding an error code included in the input code, the error code being formed of the number of surplus bits obtained by subtracting the number of bits of the variable-length code from the predetermined number of bits, to generate a sequence of error values; and an adding step of adding each sample in the sequence of integers to a corresponding error sample in the sequence of error values.

Effects of the Invention

Since errors are encoded using surplus bits that have been saved by performing variable-length encoding of integers, even if the number of bits per frame is fixed, the encoding efficiency can be improved, and the quantization distortion can be reduced.

DETAILED DESCRIPTION OF THE EMBODIMENT

Figure 1:
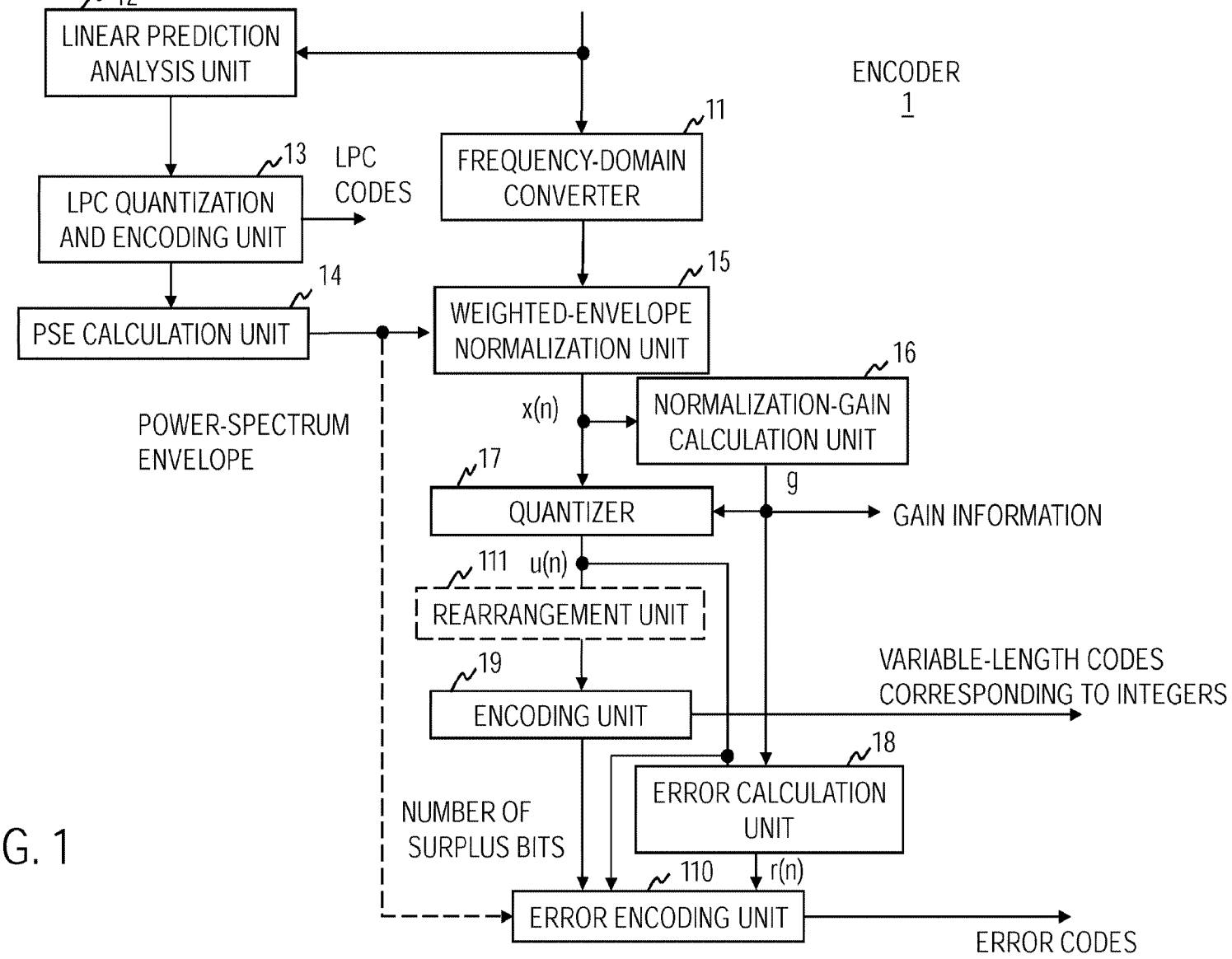
FIG. 1 is a block diagram illustrating the configuration of an encoder according to an embodiment.
Figure 2:
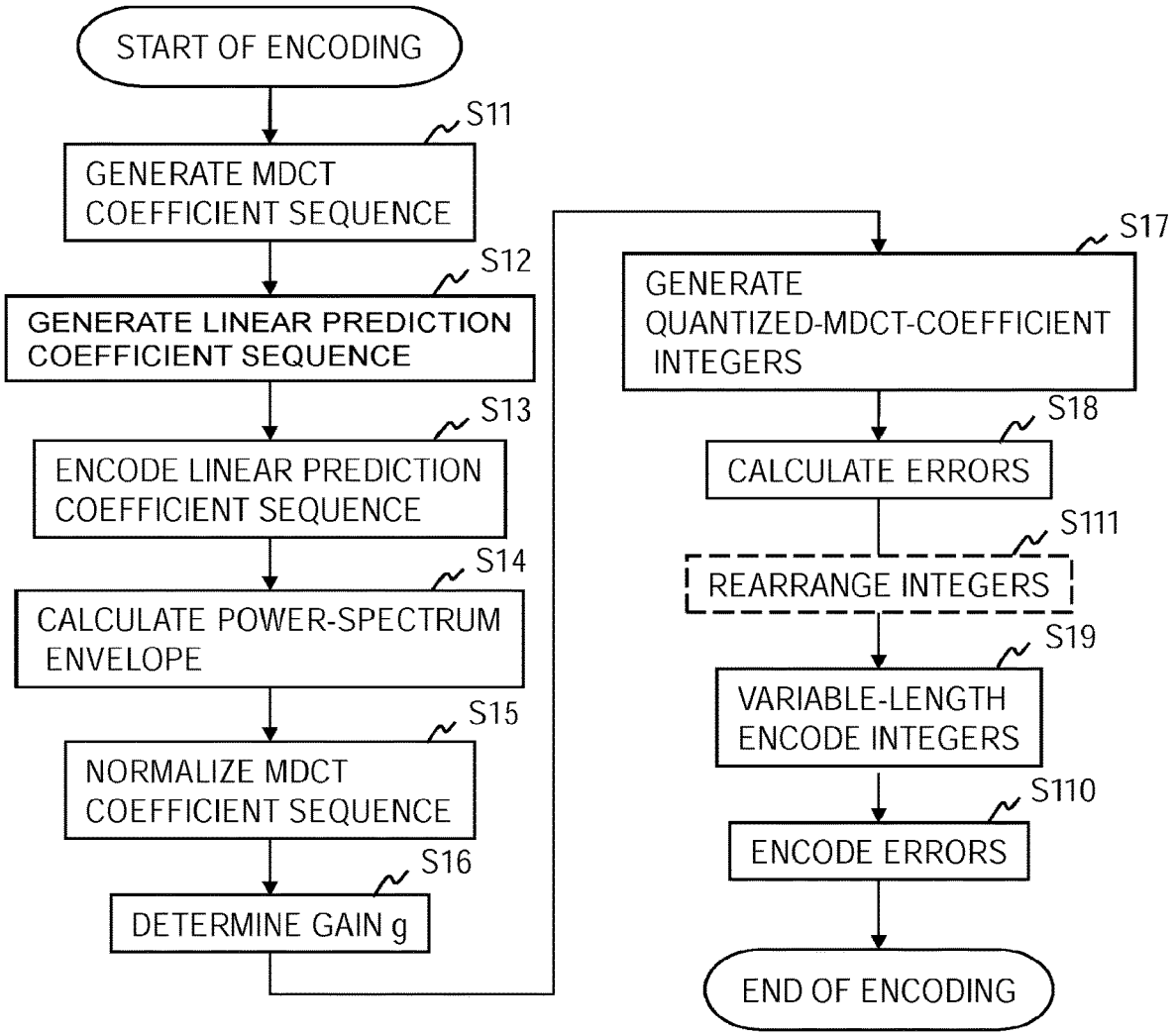
FIG. 2 is a flowchart illustrating a process in the encoder in the embodiment.

An embodiment of the present invention will now be described with reference to the drawings. Like elements will be indicated by the same reference numerals, and redundant descriptions of those elements will be omitted.

One characteristic feature of this embodiment is an improvement in encoding, that is, a reduction in encoding distortion in a framework of quantizing a frequency-domain sample sequence derived from an acoustic signal in a frame, which is a predetermined time interval, through variable-length encoding of the frequency-domain sample sequence after weighted smoothing and quantization of an error signal by using surplus bits saved by the variable-length encoding, with a determined order of priority. Even if a fixed number of bits are assigned per frame, the advantage of variable-length encoding can be obtained.

Examples of frequency-domain sample sequences derived from acoustic signals, that is, frequency-domain sample sequences based on acoustic signals, include a DFT coefficient sequence and an MDCT coefficient sequence that can be obtained by converting a digital speech or acoustic signal in units of frames from the time domain to the frequency domain, and a coefficient sequence obtained by applying a process such as normalization, weighting, or quantization to the DFT or MDCT coefficient sequence. This embodiment will be described with the MDCT coefficient sequence taken as an example.

[Encoding Embodiment]

An encoding process will be described first with reference to FIGS. 1 to 4.

As shown in FIG. 1, an encoder 1 includes a frequency-domain converter 11, a linear prediction analysis unit 12, a linear-prediction-coefficient quantization and encoding unit 13, a power-spectrum-envelope calculation unit 14, a weighted-envelope normalization unit 15, a normalization-gain calculation unit 16, a quantizer 17, an error calculation unit 18, an encoding unit 19, and an error encoding unit 110, for example. The encoder 1 performs individual steps of an encoding method illustrated in FIG. 2. The steps of the encoder 1 will be described next.

Frequency-Domain Converter 11

First, the frequency-domain converter 11 converts a digital speech or acoustic signal in units of frames into an N-point MDCT coefficient sequence in the frequency domain (step S11).

Generally speaking, an encoding part quantizes an MDCT coefficient sequence, encodes the quantized MDCT coefficient sequence, and sends the obtained code sequence to a decoding part, and the decoding part can reconstruct a quantized MDCT coefficient sequence from the code sequence and can also reconstruct a digital speech or acoustic signal in the time domain by performing an inverse MDCT transform.

The amplitude envelope of the MDCT coefficients is approximately the same as the amplitude envelope (power-spectrum envelope) of a usual DFT power spectrum. Therefore, by assigning information proportional to the logarithmic value of the amplitude envelope, the quantization distortion (quantization error) of the MDCT coefficients can be distributed evenly in the entire band, the overall quantization distortion can be reduced, and information can be compressed. The power-spectrum envelope can be efficiently estimated by using linear prediction coefficients obtained by linear prediction analysis.

The quantization error can be controlled by adaptively assigning a quantization bit(s) for each MDCT coefficient (adjusting the quantization step width after smoothing the amplitude) or by determining a code by performing adaptive weighting through weighted vector quantization. An example of the quantization method executed in the embodiment of the present invention is described here, but the present invention is not confined to the described quantization method.

Linear Prediction Analysis Unit 12

The linear prediction analysis unit 12 performs linear prediction analysis of the digital speech or acoustic signal in units of frames and obtains and outputs linear prediction coefficients up to a preset order (step S12).

Linear-Prediction-Coefficient Quantization and Encoding Unit 13

The linear-prediction-coefficient quantization and encoding unit 13 obtains and outputs codes corresponding to the linear prediction coefficients obtained by the linear prediction analysis unit 12 and quantized linear prediction coefficients (step S13).

The linear prediction coefficients may be converted to line spectral pairs (LSPs); codes corresponding to the LSPs and quantized LSPs may be obtained; and the quantized LSPs may be converted to quantized linear prediction coefficients.

The codes corresponding to the linear prediction coefficients, that is, linear prediction coefficient codes, are part of the codes sent to the decoder 2.

Power-Spectrum-Envelope Calculation Unit 14

The power-spectrum-envelope calculation unit 14 obtains a power-spectrum envelope by converting the quantized linear prediction coefficients output by the linear-prediction-coefficient quantization and encoding unit 13 into the frequency domain (step S14). The obtained power-spectrum envelope is sent to the weighted-envelope normalization unit 15. When necessary, the power-spectrum envelope is sent to the error encoding unit 110, as indicated by a broken line in FIG. 1.

Individual coefficients W(1) to W(N) in a power-spectrum envelope coefficient sequence corresponding to the individual coefficients X(1) to X(N) in the N-point MDCT coefficient sequence can be obtained by converting the quantized linear prediction coefficients into the frequency domain. For example, by the p-th order autoregressive process, which is an all-pole model, a temporal signal y(t) of time t is expressed by Formula (1) with its own past values y(t−1) to y(t−p) back to point p, a prediction residual e(t), and quantized linear prediction coefficients $\alpha_1$ to $\alpha_p$. Here, each coefficient W(n) [1≤n≤N] in the power-spectrum envelope coefficient sequence is expressed by Formula (2), where exp(•) is an exponential function whose base is the Napier's number (=e), j is the imaginary unit, and $\sigma^2$ is the prediction residual energy.

$$y(t) + \alpha_1 y(t-1) + \ldots + \alpha_p y(t-p) = e(t) \tag{1}$$

$$W(n) = \frac{\sigma^2}{2\pi} \frac{1}{|1 + \alpha_1 \exp(-jn) + \alpha_2 \exp(-2jn) + \ldots + \alpha_p \exp(-pjn)|^2} \tag{2}$$

The order p may be identical to the order of the quantized linear prediction coefficients output by the linear-prediction-coefficient quantization and encoding unit 13 or may be smaller than the order of the quantized linear prediction coefficients output by the linear-prediction-coefficient quantization and encoding unit 13.

The power-spectrum-envelope calculation unit 14 may calculate approximate values of the power-spectrum envelope or estimates of the power-spectrum envelope instead of values of the power-spectrum envelope. The values of the power-spectrum envelope are the coefficients W(1) to W(N) of the power-spectrum envelope coefficient sequence.

When calculating approximate values of the power-spectrum envelope, for example, the power-spectrum-envelope calculation unit 14 obtains the coefficients W(n), where $1 \le n \le N/4$, by Formula (2) and outputs N W'(n)s given by $W'(4n-3)=W'(4n-2)=W'(4n-1)=W'(4n)=W(n)$ $[1 \le n \le N/4]$, as approximate values of the power-spectrum envelope.

Weighted-Envelope Normalization Unit 15

The weighted-envelope normalization unit 15 normalizes the coefficients of the MDCT coefficient sequence with the power-spectrum envelope output by the power-spectrum-envelope calculation unit 14 (step S15). Here, to implement quantization that reduces distortion perceptually, the weighted-envelope normalization unit 15 normalizes the coefficients of the MDCT coefficient sequence in units of frames by using the weighted spectrum envelope coefficients obtained by smoothing the power-spectrum envelope value sequence or its square root sequence along the frequency axis. As a result, coefficients x(1) to x(N) of a frame-based weighted normalization MDCT coefficient sequence are obtained. The weighted normalization MDCT coefficient sequence is sent to the normalization-gain calculation unit 16, the quantizer 17, and the error calculation unit 18. The weighted normalization MDCT coefficient sequence generally has a rather large amplitude in the low-frequency region and has a fine structure resulting from the pitch period, but the gradient and unevenness of the amplitude are not large in comparison with the original MDCT coefficient sequence.

Normalization-Gain Calculation Unit 16

Next, the normalization-gain calculation unit 16 determines the quantization step width by using the sum of amplitude values or energy values across the entire frequency band so that the coefficients x(1) to x(N) of the weighted normalization MDCT coefficient sequence can be quantized with a given total number of bits in frames and obtains a coefficient g (hereafter gain) by which each coefficient of the weighted normalization MDCT coefficient sequence is to be divided to yield the quantization step width (step S16). Gain information that indicates this gain is part of the codes sent to the decoder 2.

Quantizer 17

The quantizer 17 quantizes the coefficients x(1) to x(N) of the weighted normalization MDCT coefficient sequence in frames with the quantization step width determined in step 16 (step S17). In other words, an integer u(n) obtained by rounding off x(n)/g to the closest whole number, x(n)/g being obtained by dividing the coefficient x(n) $[1 \le n \le N]$ of the weighted normalization MDCT coefficient sequence by the gain g, serves as a quantized MDCT coefficient. The quantized MDCT coefficient sequence in frames is sent to the error calculation unit 18 and the encoding unit 19. A value obtained by rounding up or down the fractional x(n)/g may be used as the integer u(n). The integer u(n) may be a value corresponding to x(n)/g.

In this embodiment, a sequence of x(n)/g corresponds to a sequence of samples in the frequency domain in the claims. The x(n)/g sequence is an example of a sample sequence in the frequency domain. The quantized MDCT coefficient, which is the integer u(n), corresponds to an integer corresponding to the value of each sample in the sample sequence in the frequency domain.

Error Calculation Unit 18

The weighted normalization MDCT coefficient sequence obtained in step S15, the gain g obtained in step S16, and the frame-based quantized MDCT coefficient sequence obtained in step S17 are input to the error calculation unit 18. An error resulting from quantization is given by $r(n)=x(n)/g-u(n)$ $[1 \le n \le N]$. In other words, a value obtained by subtracting the quantized MDCT coefficient u(n) corresponding to each coefficient x(n) of the weighted normalization MDCT coefficient sequence from a value obtained by dividing the coefficient x(n) by the gain g serves as a quantization error r(n) corresponding to the coefficient x(n).

A sequence of quantization errors r(n) corresponds to the sequence of errors in the claims.

Encoding Unit 19

Next, the encoding unit 19 encodes the quantized MDCT coefficient sequence (a sequence of the quantized MDCT coefficients u(n)) output by the quantizer 17 in frames and outputs obtained codes and the number of bits of the codes (step S19).

The encoding unit 19 can reduce the average code amount by employing variable-length encoding, which, for example, assigns codes having lengths depending on the frequencies of the values of the quantized MDCT coefficient sequence. Variable-length codes include Rice codes, Huffman codes, arithmetic codes, and run-length codes.

Rice encoding and run-length encoding, shown as examples here, are widely known and will not be described here (refer to Reference literature 1, for example).

Reference literature 1: David Salomon, "Data Compression: The Complete Reference," 3rd edition, Springer-Verlag, ISBN-10: 0-387-40697-2, 2004.

The generated variable-length codes become part of the codes sent to the decoder 2. The variable-length encoding method which has been executed is indicated by selection information. The selection information may be sent to the decoder 2.

Error Encoding Unit 110

As a result of variable-length encoding of the coefficients u(1) to u(N), which are integers, of the quantized MDCT coefficient sequence, the number of bits needed to express the quantized MDCT coefficient sequence is obtained and the number of surplus bits produced by compression in variable-length encoding is obtained from the predetermined number of bits. If bits can be manipulated among several frames, the surplus bits can be used effectively in the subsequent frames. If a fixed number of bits is assigned in each frame, the surplus bits should be used effectively for encoding another item, otherwise, reducing the number of average bits by variable-length encoding would become meaningless.

In this embodiment, the error encoding unit 110 encodes the quantization error $r(n)=x(n)/g-u(n)$ by using all or part of the surplus bits. Using all or part of the surplus bits will be expressed as using surplus bits, for short. The surplus bits that have not been used in encoding of the quantization error r(n) are used for other purposes, such as correcting the gain g. The quantization error r(n) is generated by rounding off fractions made by quantization and is distributed almost evenly in the range of −0.5 to +0.5. To encode all the samples (such as 256 points) by a given number of bits, an encoding method and a rule specifying the positions of target samples are determined by using the surplus bits. The aim is to minimize the error $E=\Sigma_{n \in N}(r(n)-q(n))^2$ in the entire frame, where q(n) is a sequence to be reconstructed with the surplus bits.

The error encoding unit 110 calculates the number of surplus bits by subtracting the number of bits in variable-length codes output by the encoding unit 19 from the number of bits preset as the code amount of the weighted normalization MDCT coefficient sequence. Then, the quantization error sequence obtained by the error calculation unit 18 is encoded with the number of surplus bits, and the obtained error codes are output (step S110).

The error codes are part of the codes sent to the decoder 2.

[Specific Case 1 of Error Encoding]

When quantization errors are encoded, vector quantization may be applied to a plurality of samples collectively. Generally, however, this requires a code sequence to be accumulated in a table (codebook) and requires calculation of the distance between the input and the code sequence, increasing the size of the memory and the amount of calculation. Furthermore, separate codebooks would be needed to handle any number of bits, and the configuration would become complicated.

The operation in specific case 1 will be described next.

One codebook for each possible number of surplus bits is stored beforehand in a codebook storage unit in the error encoding unit 110. Each codebook stores in advance as many vectors as the number of samples in the quantization error sequence that can be expressed with the number of surplus bits corresponding to the codebook, associated with codes corresponding to the vectors.

The error encoding unit 110 calculates the number of surplus bits, selects a codebook corresponding to the calculated number of surplus bits from the codebooks stored in the codebook storage unit, and performs vector quantization by using the selected codebook. The encoding process after selecting the codebook is the same as that in general vector quantization. As error codes, the error encoding unit 110 outputs codes corresponding to vectors that minimize the distances between the vectors of the selected codebook and the input quantization error sequence or that minimize the correlation between them.

In the description given above, the number of vectors stored in the codebook is the same as the number of samples in the quantization error sequence. The number of sample vectors stored in the codebook may also be a integral submultiple of the number of samples in the quantization error sequence; the quantization error sequence may be vector-quantized for each group of a plurality of samples; and a plurality of obtained codes may be used as error codes.

[Specific Case 2 of Error Encoding Unit 110]

When the quantization error samples included in the quantization error sequence are encoded one at a time, the order of priority of the quantization error samples included in the quantization error sequence is determined, and the quantization error samples that can be encoded with the surplus bits are encoded in descending order of priority. For example, the quantization error samples are encoded in descending order of absolute value or energy.

Figure 3:
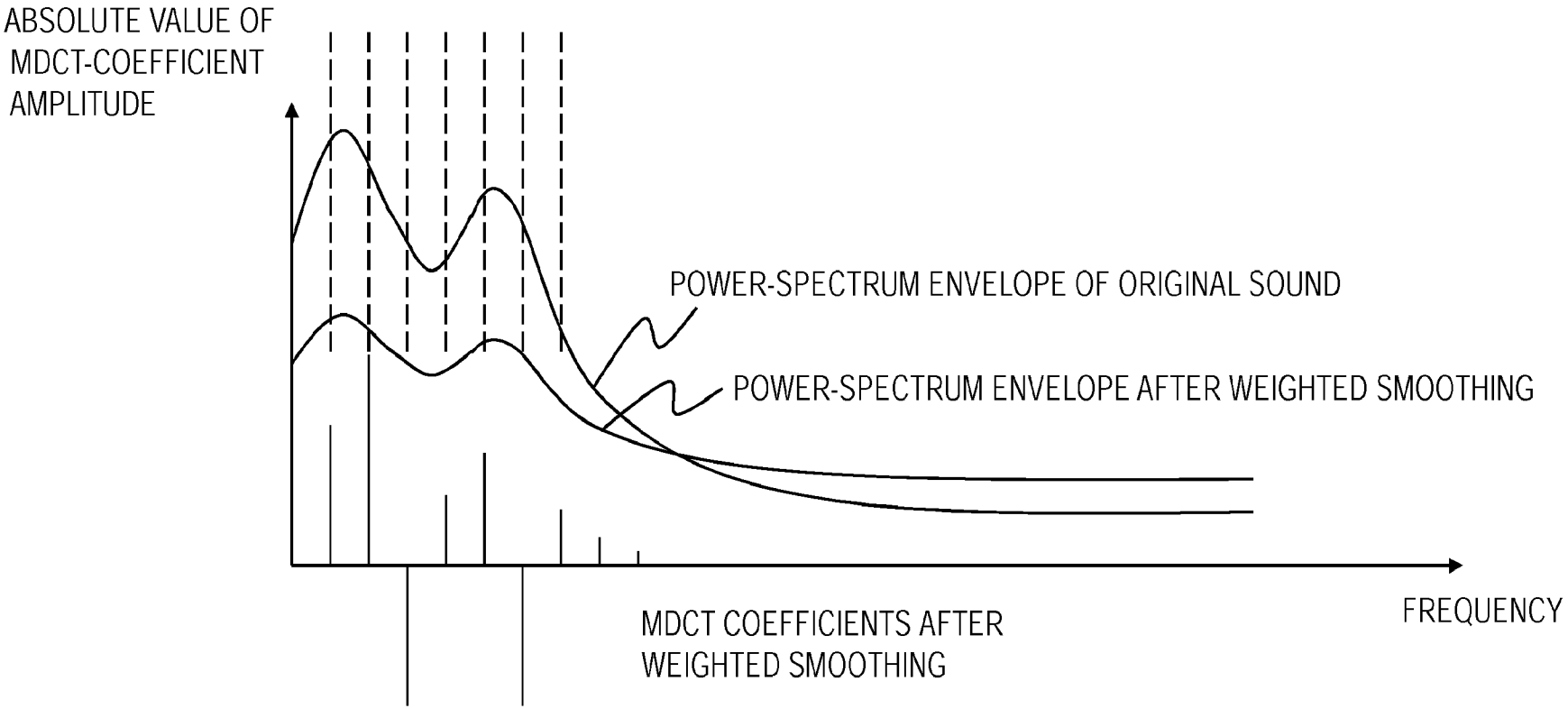
FIG. 3 is a view illustrating the relationship between a weighted normalization MDCT coefficient and a power-spectrum envelope.

The order of priority can be determined with reference to the values of the power-spectrum envelope, for example. Like the values of the power-spectrum envelope, approximate values of the power-spectrum envelope, estimates of the power-spectrum envelope, values obtained by smoothing any of these values along the frequency axis, mean values of a plurality of samples of any of these values, or values having the same magnitude relationship as at least one of these values may be used, of course, but using values of the power-spectrum envelope will be described below. As an example shown in FIG. 3 illustrates, perceptual distortion in an acoustic signal such as speech or musical sound can be reduced by making a trend in the amplitudes of the sequence of samples to be quantized in the frequency domain (corresponding to the spectrum envelope after weighted smoothing in FIG. 3) closer to the power-spectrum envelope of the acoustic signal (corresponding to the spectrum envelope of the original sound in FIG. 3). If the values of the power-spectrum envelope turn out to be large, corresponding weighted normalization MDCT coefficients x(n) would also be large. Even if the weighted normalization MDCT coefficients x(n) are large, the quantization error r(n) ranges from −0.5 to +0.5.

If the weighted normalization MDCT coefficients x(n) are very small, in other words, if the coefficients are smaller than half of the step width, values obtained by dividing the weighted normalization MDCT coefficients x(n) by the gain g is 0, and the quantization errors r(n) are far smaller than 0.5. If the values of the power-spectrum envelope are rather small, encoding of the quantization errors r(n) as well as the weighted normalization MDCT coefficients x(n) would produce a small effect on the perceptual quality, and they may be excluded from the items to be encoded in the error encoding unit 110. If the power-spectrum envelope is rather large, it is impossible to distinguish a sample having a large quantization error from other samples. In that case, quantization error samples r(n) are encoded using one bit each, only for the number of quantization error samples corresponding to the number of surplus bits, in ascending order of the position of the sample on the frequency axis (ascending order of frequency) or in descending order of the value of the power-spectrum envelope. Just excluding values of the power-spectrum envelope up to a certain level would be enough.

In encoding a quantization error sequence, it is assumed that a quantization error sample is $r(n)=x$ and its distortion caused by quantization is $E=\int_0^{0.5} f(x)(x-\mu)^2 dx$, where f(x) is a probability distribution function, and μ is the absolute value of a value reconstructed by the decoder. To minimize distortion E caused by quantization, μ should be set so that $dE/d\mu=0$. That is, μ should be the centroid of the probability distribution of the quantization errors r(n).

If the value obtained by dividing the weighted normalization MDCT coefficient x(n) by the gain g and rounding off the result to a whole number, that is, the value of the corresponding quantized MDCT coefficient u(n), is not '0', the distribution of the quantization errors r(n) is virtually even, and $\mu=0.25$ can be set.

If the value obtained by dividing the weighted normalization MDCT coefficient x(n) by the gain g and rounding off the result to a whole number, that is, the value of the corresponding quantized MDCT coefficient u(n), is '0', the distribution of the quantization errors r(n) tends to converge on '0', and the centroid of the distribution should be used as the value of μ.

In that case, a quantization error sample to be encoded may be selected for each set of a plurality of quantization error samples whose corresponding quantized MDCT coefficients u(n) are '0', and the position of the selected quantization error sample in the set of quantization error samples and the value of the selected quantization error sample may be encoded and sent as an error code to the decoder 2. For example, among four quantization error samples whose corresponding quantized MDCT coefficients u(n) are '0', a quantization error sample having the largest absolute value is selected; the value of the selected quantization error sample is quantized (it is determined whether it is positive or negative, for example), and this information is sent as a single bit; and the position of the selected quantization error sample is sent as two bits. The codes of the quantization error samples that have not been selected are not sent to the decoder 2, and the corresponding decoded values in the decoder 2 are '0'. Generally, q bits are needed to report to the decoder the position of the sample which has been selected from among $2^q$ samples.

Here, μ should be the value of the centroid of the distribution of samples having the largest absolute values of quantization errors in the sets of the plurality of samples.

Figure 4:
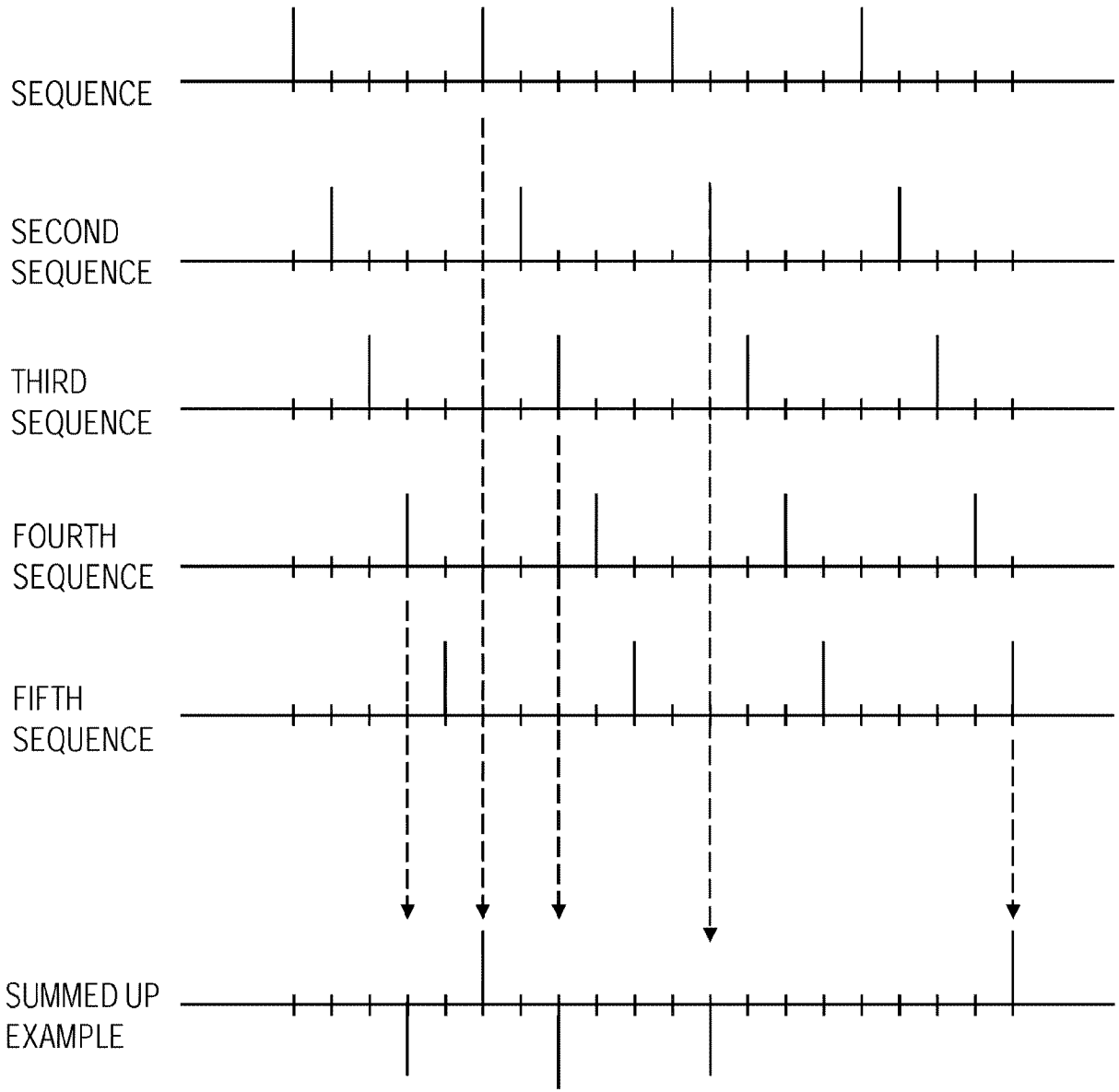
FIG. 4 is a view illustrating an example of a process performed when there are many surplus bits.

With many surplus bits, scattered samples can be expressed by combining a plurality of sequences, as shown in FIG. 4. In a first sequence, a positive or negative pulse (requiring two bits) is set at just one of four positions, and the other positions can be set to zero. Three bits are needed to express the first sequence. The second to fifth sequences can be encoded in the same way, with a total of 15 bits.

Encoding can be performed as described below, where the number of surplus bits is U, the number of quantization error samples whose corresponding quantized MDCT coefficients u(n) are not '0' among the quantization error samples constituting the quantization error sequence is T, and the number of quantization error samples whose corresponding quantized MDCT coefficients u(n) are '0' is S.

$$U \leq T \tag{A}$$

The error encoding unit 110 selects U quantization error samples among T quantization error samples whose corresponding quantized MDCT coefficients u(n) are not '0' in the quantization error sequence, in descending order of the corresponding value of the power-spectrum envelope; generates a one-bit code serving as information expressing whether the quantization error sample is positive or negative for each of the selected quantization error samples; and outputs the generated U bits of codes as error codes. If the corresponding values of the power-spectrum envelope are the same, the samples should be selected, for example, in accordance with another preset rule, such as selecting quantization error samples in ascending order of the position on the frequency axis (quantization error samples in ascending order of frequency).

$$T < U \leq T+S \tag{B}$$

The error encoding unit 110 generates a one-bit code serving as information expressing whether the quantization error sample is positive or negative, for each of the T quantization error samples whose corresponding quantized MDCT coefficients u(n) are not '0' in the quantization error sequence.

The error encoding unit 110 also encodes quantization error samples whose corresponding quantized MDCT coefficients u(n) are '0' in the quantization error sequence, with U−T bits. If there are a plurality of quantization error samples whose corresponding quantized MDCT coefficients u(n) are '0', they are encoded in descending order of the corresponding value of the power-spectrum envelope. Specifically, a one-bit code expressing whether the quantization error sample is positive or negative is generated for each of U-T samples among the quantization error samples whose corresponding quantized MDCT coefficients u(n) are '0', in descending order of the corresponding value of the power-spectrum envelope. Alternatively, a plurality of quantization error samples are taken out in descending order of the corresponding value of the power-spectrum envelope from the quantization error samples whose corresponding quantized MDCT coefficients u(n) are '0' and are vector-quantized in each group of a plurality quantization error samples to generate U−T bits of codes. If the corresponding values of the power-spectrum envelope are the same, the samples are selected, for example, in accordance with a preset rule, such as selecting quantization error samples in ascending order of the position on the frequency axis (quantization error samples in ascending order of frequency).

The error encoding unit 110 further outputs a combination of the generated U-bit codes and the U−T-bit codes as error codes.

$$T+S < U \tag{C}$$

The error encoding unit 110 generates a one-bit first-round code expressing whether the quantization error sample is positive or negative, for each of the quantization error samples included in the quantization error sequence.

The error encoding unit 110 further encodes quantization error samples by using the remaining U−(T+S) bits, in a way described in (A) or (B) above. A second round of (A) is executed on the encoding errors of the first round with the U−(T+S) bits being set anew to U bits. As a result, two-bit quantization per quantization error sample is performed on at least some of the quantization error samples. The values of quantization errors r(n) in the first-round encoding range evenly from −0.5 to +0.5, and the values of the errors in the first round to be encoded in the second round range from −0.25 to +0.25.

Specifically, the error encoding unit 110 generates a one-bit second-round code expressing whether the value obtained by subtracting a reconstructed value of 0.25 from the value of the quantization error sample is positive or negative, for quantization error samples whose corresponding quantized MDCT coefficients u(n) are not '0' and whose corresponding quantization errors r(n) are positive among the quantization error samples included in the quantization error sequence.

The error encoding unit 110 also generates a one-bit second-round code expressing whether the value obtained by subtracting a reconstructed value −0.25 from the value of the quantization error sample is positive or negative, for quantization error samples whose corresponding quantized MDCT coefficients u(n) are not '0' and whose corresponding quantization errors r(n) are negative among the quantization error samples included in the quantization error sequence.

The error encoding unit 110 further generates a one-bit second-round code expressing whether the value obtained by subtracting a reconstructed value A (A is a preset positive value smaller than 0.25) from the value of the quantization error sample is positive or negative, for quantization error samples whose corresponding quantized MDCT coefficients u(n) are '0' and whose corresponding quantization errors r(n) are positive among the quantization error samples included in the quantization error sequence.

The error encoding unit 110 further generates a one-bit second-round code expressing whether the value obtained by subtracting a reconstructed value −A (A is a preset positive value smaller than 0.25) from the value of the quantization error sample is positive or negative, for error samples whose corresponding quantized MDCT coefficients u(n) are '0' and whose corresponding quantization errors r(n) are negative among the quantization error samples included in the quantization error sequence.

The error encoding unit 110 outputs a combination of the first-round code and the second-round code as an error code.

If not all of the T+S quantization error samples of the quantization error sequence are encoded or if quantization error samples whose corresponding quantized MDCT coefficients u(n) are '0' are encoded together, using one bit or less per sample, the quantization error sequence is encoded by using UU bits, which are fewer than U bits. In this case, the condition of (C) can be expressed as T+S<UU.

Approximate values of the power-spectrum envelope or estimates of the power-spectrum envelope may be used instead of the values of power-spectrum envelope in (A) and (B) above.

Values obtained by smoothing the values of power-spectrum envelope, by smoothing approximate values of the power-spectrum envelope, or by smoothing estimates of the power-spectrum envelope along the frequency axis may also be used instead of the values of the power-spectrum envelope in (A) and (B) above. As the values obtained by smoothing, the weighted spectrum envelope coefficients obtained by the weighted-envelope normalization unit 15 may be input to the error encoding unit 110, or the values may also be calculated by the error encoding unit 110.

Mean values of a plurality of values of the power-spectrum envelope may also be used instead of the values of the power-spectrum envelope in (A) and (B) above. For example, N W"(n)s obtained as $W''(4n-3)=W''(4n-2)=W''(4n-1)=W''(4n)=(W(4n-3)+W(4n-2)+W(4n-1)+W(4n))/4$ $[1\leq n\leq N/4]$ may be used. Mean values of approximate values of the power-spectrum envelope or mean values of estimates of the power-spectrum envelope may be used instead of the values of power-spectrum envelope $W(n)$ $[1\leq n\leq N]$. Mean values of values obtained by smoothing the values of the power-spectrum envelope, by smoothing approximate values of the power-spectrum envelope, or by smoothing estimates of the power-spectrum envelope along the frequency axis may also be used. Each mean value here is a value obtained by averaging target values over a plurality of samples, that is, a value obtained by averaging target values in a plurality of samples.

Values having the same magnitude relationship as at least one type of the values of the power-spectrum envelope, approximate values of the power-spectrum envelope, estimates of the power-spectrum envelope, values obtained by smoothing any of the above-mentioned values, and values obtained by averaging any of the above-mentioned values over a plurality of samples may also be used instead of the values of the power-spectrum envelope in (A) and (B) above. In that case, the values having the same magnitude relationship are calculated by the error encoding unit 110 and used. The values having the same magnitude relationship include squares and square roots. For example, values having the same magnitude relationship as the values of the power-spectrum envelope $W(n)$ $[1\leq n\leq N]$ are the squares $(W(n))^2$ $[1\leq n\leq N]$ of the values of the power-spectrum envelope and the square roots $(W(n))^{1/2}$ $[1\leq n\leq N]$ of the values of the power-spectrum envelope.

If the square roots of the values of the power-spectrum envelope or values obtained by smoothing the square roots are obtained by the weighted-envelope normalization unit 15, what is obtained by the weighted-envelope normalization unit 15 may be input to the error encoding unit 110.

As indicated by a broken-line box in FIG. 1, a rearrangement unit 111 may be provided to rearrange the quantized MDCT coefficient sequence. In that case, the encoding unit 19 variable-length-encodes the quantized MDCT coefficient sequence rearranged by the rearrangement unit 111. Since the rearrangement of the quantized MDCT coefficient sequence based on periodicity can sometimes reduce the number of bits greatly in variable-length encoding, an improvement in encoding efficiency can be expected by encoding errors.

The rearrangement unit 111 outputs, in units of frames, a rearranged sample sequence which (1) includes all samples in the quantized MDCT coefficient sequence, and in which (2) some of those samples included in the quantized MDCT coefficient sequence have been rearranged to put together samples having an equal index or a nearly equal index reflecting the magnitude of the sample (step S111). Here, the index reflecting the magnitude of the sample is the absolute value of the amplitude of the sample or the power (square) of the sample, for example, but is not confined to them. For details of the rearrangement unit 111, refer to Japanese Patent Application No. 2010-225949 (PCT/JP2011/072752 is corresponding to WO2012/046685).

[Decoding Embodiment]

A decoding process will be described next with reference to FIGS. 5 and 6.

The decoder 2 reconstructs an MDCT coefficient by performing the encoding process performed in the encoder 1 in reverse order. In this embodiment, codes input to the decoder 2 include variable-length codes, error codes, gain information, and linear-prediction-coefficient codes. If selection information is output from the encoder 1, the selection information is also input to the decoder 2.

Figure 5:
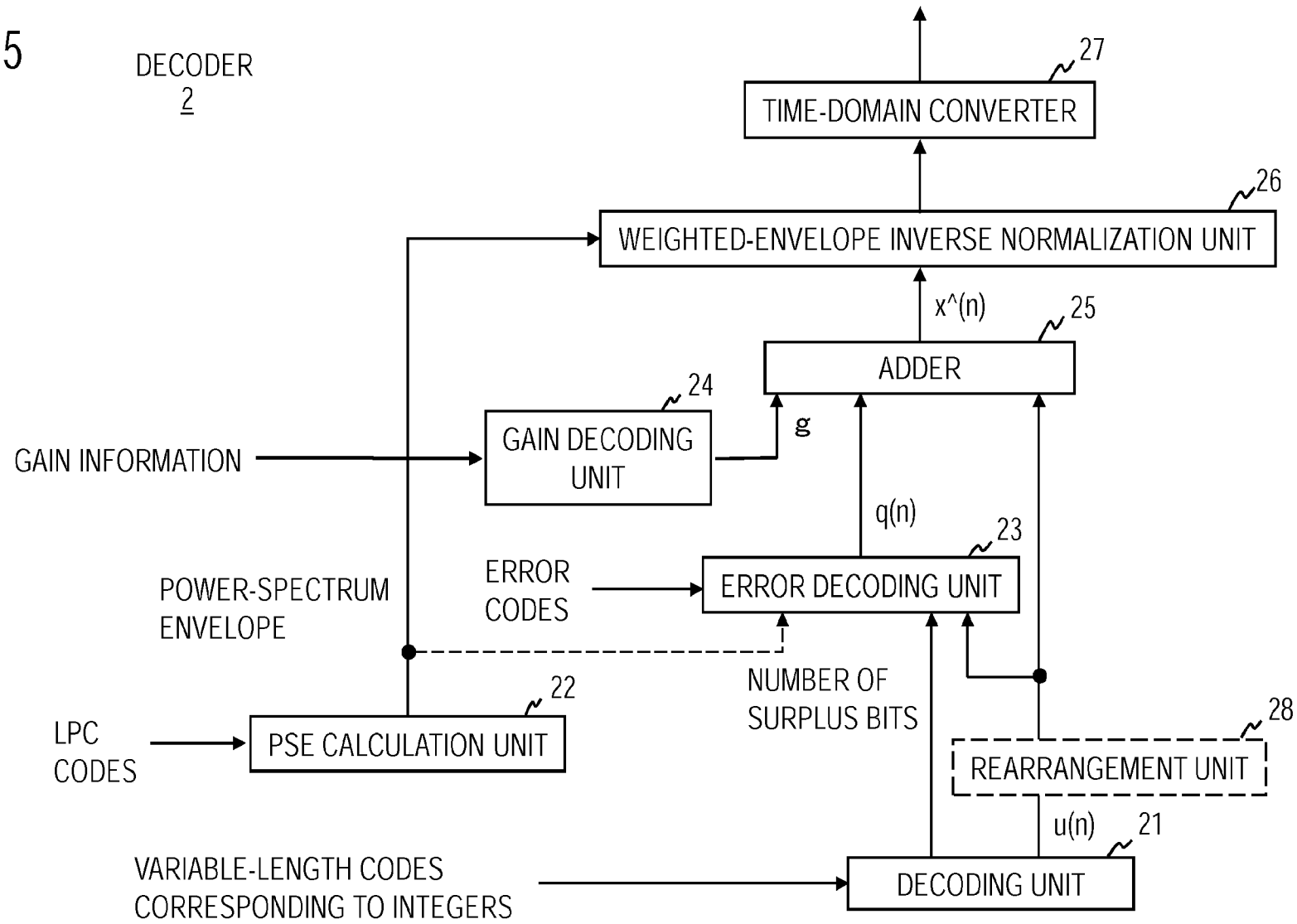
FIG. 5 is a block diagram illustrating the configuration of a decoder in the embodiment.
Figure 6:
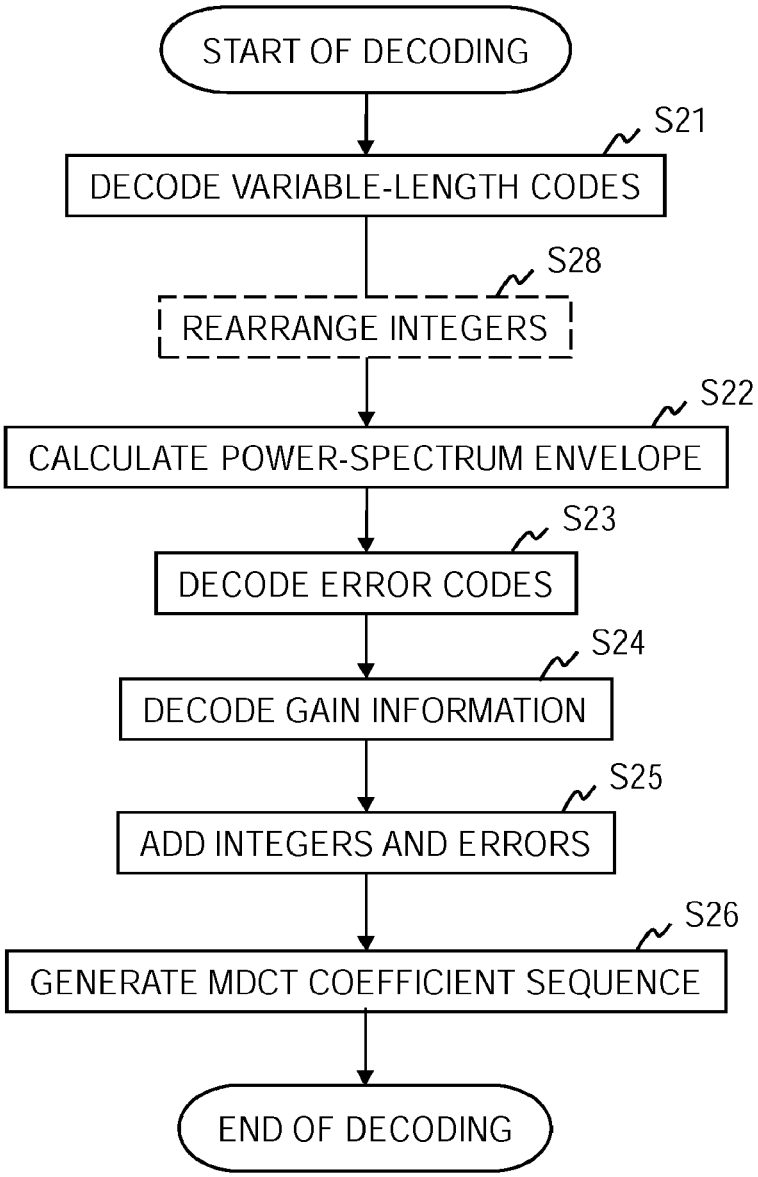
FIG. 6 is a flowchart illustrating a process in the decoder in the embodiment.

As shown in FIG. 5, the decoder 2 includes a decoding unit 21, a power-spectrum-envelope calculation unit 22, an error decoding unit 23, a gain decoding unit 24, an adder 25, a weighted-envelope inverse normalization unit 26, and a time-domain converter 27, for example. The decoder 2 performs the steps of a decoding method shown in FIG. 6 as an example. The steps of the decoder 2 will be described next.

Decoding Unit 21

First, the decoding unit 21 decodes variable-length codes included in the input codes in units of frames and outputs a sequence of decoded quantized MDCT coefficients $u(n)$, that is, coefficients that are identical to the quantized MDCT coefficients $u(n)$ in the encoder, and the number of bits of the variable-length codes (step S21). A variable-length decoding method corresponding to the variable-length encoding method executed to obtain the code sequence is executed, of course. Details of the decoding process performed by the decoding unit 21 corresponds to the details of the encoding process performed by the encoding unit 19 of the encoder 1. The description of the encoding process is quoted here as a substitute for a detailed description of the decoding process because the decoding corresponding to the encoding that has been executed is the decoding process to be performed in the decoding unit 21.

The sequence of decoded quantized MDCT coefficients $u(n)$ corresponds to the sequence of integers in the claims.

The variable-length encoding method that has been executed is indicated by the selection information. If the selection information includes, for example, information indicating the area in which Rice encoding has been applied and Rice parameters, information indicating the area in which run-length encoding has been applied, and information indicating the type of entropy encoding, decoding methods corresponding to the encoding methods are applied to the corresponding areas of the input code sequence. A decoding process corresponding to Rice encoding, a decoding process corresponding to entropy encoding, and a decoding process corresponding to run-length encoding are widely known, and a description of them will be omitted (for example, refer to Reference literature 1, described above).

Power-Spectrum-Envelope Calculation Unit 22

The power-spectrum-envelope calculation unit 22 decodes the linear-prediction-coefficient codes input from the encoder 1 to obtain quantized linear prediction coefficients and converts the obtained quantized linear prediction coefficients into the frequency domain to obtain a power-spectrum envelope (step 22). The process for obtaining the power-spectrum envelope from the quantized linear prediction coefficients is the same as that in the power-spectrum-envelope calculation unit 14 of the encoder 1.

Approximate values of the power-spectrum envelope or estimates of the power-spectrum envelope may be calculated instead of the values of the power-spectrum envelope, as in the power-spectrum-envelope calculation unit 14 of the encoder 1. The type of the values, however, must be the same as that in the power-spectrum-envelope calculation unit 14 of the encoder 1. For example, if the power-spectrum-envelope calculation unit 14 of the encoder 1 has obtained approximate values of the power-spectrum envelope, the power-spectrum-envelope calculation unit 22 of the decoder 2 must also obtain approximate values of the power-spectrum envelope.

If quantized linear prediction coefficients corresponding to the linear-prediction-coefficient codes are obtained by another means in the decoder 2, the quantized linear prediction coefficients should be used to calculate the power-spectrum envelope. If a power-spectrum envelope has been calculated by another means in the decoder 2, the decoder 2 does not have to include the power-spectrum-envelope calculation unit 22.

Error Decoding Unit 23

First, the error decoding unit 23 calculates the number of surplus bits by subtracting the number of bits output by the decoding unit 21 from the number of bits preset as the encoding amount of the quantized MDCT coefficient sequence. The error decoding unit 23 then decodes the error codes output by the error encoding unit 110 of the encoder 1 by using the decoding method corresponding to the encoding method used in the error encoding unit 110 of the encoder 1 and obtains decoded quantization errors q(n) (step S23). The number of bits assigned to the quantization error sequence in the encoder 1 is obtained from the number of surplus bits based on the number of bits used in the variable-length encoding indicated by the decoding unit 21. Since the encoder 1 and decoder 2 determine the correspondence of samples and steps between encoding and decoding in units of sets of surplus bits, unique decoding becomes possible.

A sequence of decoded quantization errors corresponds to the sequence of errors in the claims.

[Specific Case 1 of Error Decoding] (Corresponding to [Specific Case 1 of Error Encoding] in Encoder 1)

One codebook for each possible value of the number of surplus bits is stored beforehand in a codebook storage unit in the error decoding unit 23. Each codebook stores in advance as many vectors as the number of samples in the decoded quantization error sequence that can be expressed with the number of surplus bits corresponding to the codebook, associated with codes corresponding to the vectors.

The error decoding unit 23 calculates the number of surplus bits, selects a codebook corresponding to the calculated number of surplus bits from the codebooks stored in the codebook storage unit, and performs vector inverse-quantization by using the selected codebook. The decoding process after selecting the codebook is the same as the general vector inverse-quantization. In other words, among vectors in the selected codebook, vectors corresponding to the input error codes are output as decoded to quantization errors q(n).

In the description given above, the number of vectors stored in the codebook is the same as the number of samples in the decoded quantization error sequence. The number of sample vectors stored in the codebook may also be an integral submultiple of the number of samples in the decoded quantization error sequence, and a plurality of codes included in the input error codes may be vector-inverse-quantized for each of a plurality of parts to generate the decoded quantization error sequence.

[Specific Case 2 of Error Decoding Unit 23] (Corresponding to [Specific Case 2 of Error Encoding] in Encoder 1)

A preferable decoding procedure will be described next, where the number of surplus bits is U, the number of samples whose corresponding decoded quantized MDCT coefficients u(n) output from the decoding unit 21 are not '0' is T, and the number of samples whose corresponding decoded quantized MDCT coefficients u(n) output from the decoding unit 21 are '0' is S.

$$U \leq T \tag{A}$$

The error decoding unit 23 selects U samples of T samples whose corresponding decoded quantized MDCT coefficients u(n) are not '0', in descending order of the corresponding value of the power-spectrum envelope, decodes a one-bit code included in the input error code to obtain information expressing whether the sample is positive or negative, adds the obtained positive-negative information to the absolute value 0.25 of the reconstructed value, and outputs the reconstructed value +0.25 or −0.25 as a decoded quantization error q(n) corresponding to the decoded quantized MDCT coefficient u(n), for each of the selected samples. If the corresponding values of the power-spectrum envelope are the same, the samples should be selected in accordance with a preset rule, such as selecting quantization error samples in ascending order of the position on the frequency axis (quantization error samples in ascending order of frequency), for example. A rule corresponding to the rule used in the error encoding unit 110 of the encoder 1 is held beforehand in the error decoding unit 23, for example.

$$T < U \leq T + S \tag{B}$$

The error decoding unit 23 decodes a one-bit code included in the input error code for each of samples whose corresponding decoded quantized MDCT coefficients u(n) are not '0' to obtain information indicating whether the decoded quantization error sample is positive or negative, adds the obtained positive-negative information to the absolute value 0.25 of the reconstructed value, and outputs the reconstructed value +0.25 or −0.25 as a decoded quantization error q(n) corresponding to the decoded quantized MDCT coefficient u(n).

The error decoding unit 23 also decodes a one-bit code included in the input error code, for each of U−T samples whose corresponding decoded quantized MDCT coefficients u(n) are '0', in descending order of the corresponding value of the power-spectrum envelope, to obtain information indicating whether the decoded quantization error sample is positive or negative; adds the obtained positive-negative information to the absolute value A of the reconstructed value, which is a preset positive value smaller than 0.25; and outputs the reconstructed value +A or −A as the decoded quantization error q(n) corresponding to the decoded quantized MDCT coefficient u(n).

Alternatively, the error decoding unit 23 vector-inverse-quantizes (U−T)-bit codes included in the error codes for a plurality of samples whose corresponding decoded quantized MDCT coefficients u(n) are '0', in descending order of the corresponding value of the power-spectrum envelope to obtain a sequence of corresponding decoded quantization error samples, and outputs each value of the obtained decoded quantization error samples as the decoded quantization error q(n) corresponding to the decoded quantized MDCT coefficient u(n).

When the values of the quantized MDCT coefficient u(n) and the decoded quantized MDCT coefficient u(n) are not '0', the absolute value of the reconstructed value is set to '0.25', for example; when the values of the quantized MDCT coefficient u(n) and the decoded quantized MDCT coefficient u(n) are '0', the absolute value of the reconstructed value is set to A ($0<A<0.25$), as described above. The absolute values of reconstructed values are examples. The absolute value of the reconstructed value obtained when the values of the quantized MDCT coefficient u(n) and the decoded quantized MDCT coefficient u(n) are not '0' needs to be larger than the absolute value of the reconstructed value obtained when the values of the quantized MDCT coefficient u(n) and the decoded quantized MDCT coefficient u(n) are '0'. The values of the quantized MDCT coefficient u(n) and the decoded quantized MDCT coefficient u(n) correspond to the integers in the claims.

If the corresponding values of the power-spectrum envelope are the same, samples should be selected in accordance with a preset rule, such as selecting samples in ascending order of the position on the frequency axis (in ascending order of frequency), for example.

$$T+S<U \tag{C}$$

The error decoding unit 23 performs the following process on samples whose decoded quantized MDCT coefficients u(n) are not '0'.

The error decoding unit 23 decodes the one-bit first-round code included in the input error code to obtain positive-negative information, adds the obtained positive-negative information to the absolute value 0.25 of the reconstructed value, and sets the reconstructed value +0.25 or −0.25 as a first-round decoded quantization error $q_1(n)$ corresponding to the decoded quantized MDCT coefficient u(n). The error decoding unit 23 further decodes the one-bit second-round code included in the input error code to obtain positive-negative information, adds the obtained positive-negative information to the absolute value 0.125 of the reconstructed value, and sets the reconstructed value +0.125 or −0.125 as a second-round decoded quantization error $q_2(n)$. The first-round decoded quantization error $q_1(n)$ and the second-round decoded quantization error $q_2(n)$ are added to make a decoded quantization error q(n).

The error decoding unit 23 performs the following process on samples whose decoded quantized MDCT coefficients u(n) are '0'.

The error decoding unit 23 decodes the one-bit first-round code included in the input error code to obtain positive-negative information, adds the obtained positive-negative information to the absolute value A of the reconstructed value, which is a positive value smaller than 0.25, and sets the reconstructed value +A or −A as a first-round decoded quantization error $q_1(n)$ corresponding to the decoded quantized MDCT coefficient u(n). The error decoding unit 23 further decodes the one-bit second-round code included in the input error code to obtain positive-negative information, adds the obtained positive-negative information to the absolute value A/2 of the reconstructed value, and sets the reconstructed value +A/2 or −A/2 as a second-round decoded quantization error $q_2(n)$. The first-round decoded quantization error $q_1(n)$ and the second-round decoded quantization error $q_2(n)$ are added to make a decoded quantization error q(n).

No matter whether the corresponding values of the quantized MDCT coefficient u(n) and the decoded quantized MDCT coefficient u(n) are '0' or not '0', the absolute value of the reconstructed value corresponding to the second-round code is a half of the absolute value of the reconstructed value corresponding to the first-round code.

Approximate values of the power-spectrum envelope, estimates of the power-spectrum envelope, values obtained by smoothing any of those values, values obtained by averaging any of those values over pluralities of samples, or values having the same magnitude relationship as any of those values may also be used instead of the values of the power-spectrum envelope in (A) and (B) above. The same type of values as used in the error encoding unit 110 of the encoder 1 must be used.

Gain Decoding Unit 24

The gain decoding unit 24 decodes input gain information to obtain gain g and outputs it (step S24). The gain g is sent to the adder 25.

Adder 25

The adder 25 adds the coefficients u(n) of the decoded quantized MDCT coefficient sequence output by the decoding unit 21 and the corresponding coefficients q(n) of the decoded quantization error sequence output by the error decoding unit 23 in units of frames to obtain their sums. The adder 25 generates a sequence by multiplying the sums by the gain g output by the gain decoding unit 24 and provides it as a decoded weighted normalization MDCT coefficient sequence (S25). Each coefficient in the decoded weighted normalization MDCT coefficient sequence is denoted $\hat{x}(n)$, where $\hat{x}(n)=(u(n)+q(n))\cdot g$.

The sequence of sums generated by the adder 25 corresponds to the sample sequence in the frequency domain in the claims.

Weighted-Envelope Inverse Normalization Unit 26

The weighted-envelope inverse normalization unit 26 then obtains an MDCT coefficient sequence by dividing the coefficients $\hat{x}(n)$ of the decoded weighted normalization MDCT coefficient sequence by the values of the power-spectrum envelope in units of frames (step S26).

Time-Domain Converter 27

Next, the time-domain converter 27 converts the MDCT coefficient sequence output by the weighted-envelope inverse normalization unit 26 into the time domain in units of frames and obtains a digital speech or acoustic signal in unit of frames (step S27).

The processing in steps S26 and S27 is a conventional one, and its detailed description is omitted here.

If rearrangement has been performed by the rearrangement unit 111 in the encoder 1, the sequence of decoded quantized MDCT coefficients u(n) generated by the decoding unit 21 is rearranged by a rearrangement unit in the decoder 2 (step S28), and the rearranged sequence of decoded quantized MDCT coefficients u(n) is sent to the error decoding unit 23 and the adder 25. In that case, the error decoding unit 23 and the adder 25 perform the processing described above on the rearranged sequence of decoded quantized MDCT coefficients u(n), instead of the sequence of decoded quantized MDCT coefficients u(n) generated by the decoding unit 21.

By using the compression effect achieved by variable-length encoding, quantization distortion and the amount of codes can be reduced even if the total number of bits in frames is fixed.

[Hardware Configurations of Encoder and Decoder]

The encoder 1 and the decoder 2 in the embodiment described above include an input unit to which a keyboard or the like can be connected, an output unit to which a liquid crystal display or the like can be connected, a central processing unit (CPU), memories such as a random access memory (RAM) and a read only memory (ROM), an external storage unit such as a hard disk drive, and a bus to which the input unit, the output unit, the CPU, the RAM, the ROM, and the external storage unit are connected to allow data exchange among them, for example. When necessary, a unit (drive) for reading and writing a CD-ROM or other recording media may also be added to the encoder 1 or decoder 2.

The external storage unit of the encoder 1 and the decoder 2 stores programs for executing encoding and decoding and data needed in the programmed processing. The programs may also be stored in the ROM, which is a read-only storage device, as well as the external storage unit. Data obtained in the programmed processing are stored in the RAM or the external storage unit as needed. The storage devices for storing the data and the addresses of storage areas will be referred to just as a storage unit.

The storage unit of the encoder 1 stores programs for encoding a sample sequence in the frequency domain derived from a speech or acoustic signal and for encoding errors.

The storage unit of the decoder 2 stores programs for decoding input codes.

In the encoder 1, each program and data needed in the processing of the program are read into the RAM from the storage unit when necessary, and the CPU interprets them and executes the processing. Encoding is implemented by the CPU performing given functions (such as the error calculation unit 18, the error encoding unit 110, and the encoding unit 19).

In the decoder 2, each program and data needed in the processing of the program are read into the RAM from the storage unit when needed, and the CPU interprets them and executes the processing. Decoding is implemented by the CPU performing given functions (such as the decoding unit 21).

[Modifications]

As a quantized MDCT coefficient, the quantizer 17 in the encoder 1 may use $G(x(n)/g)$ obtained by companding the value of $x(n)/g$ by a given function G, instead of $x(n)/g$. Specifically, the quantizer 17 uses an integer corresponding to $G(x(n)/g)$ obtained by companding $x(n)/g$ with a function G, $x(n)/g$ being obtained by dividing the coefficient $x(n)$ $[1 \leq n \leq N]$ of the weighted normalization MDCT coefficient sequence by the gain g, such as an integer $u(n)$ obtained by rounding off $G(x(n)/g)$ to the nearest whole number or by rounding up or down a fractional part. This quantized MDCT coefficient is encoded by the encoding unit 19.

The function G is $G(h)=\mathrm{sign}(h)\times|h|^{a}$, for example, where sign(h) is a polarity sign function that outputs the positive or negative sign of the input h. This sign(h) outputs '1' when the input h is a positive value and outputs '−1' when the input h is a negative value, for example. |h| represents the absolute value of h, and a is a given number such as 0.75.

In this case, the value $G(x(n)/g)$ obtained by companding the value $x(n)/g$ by a given function G corresponds to the sample sequence in the frequency domain in the claims. The quantization error $r(n)$ obtained by the error calculation unit 18 is $G(x(n)/g)-u(n)$. The quantization error $r(n)$ is encoded by the error encoding unit 110.

Here, the adder 25 in the decoder 2 obtains a decoded weighted normalization MDCT coefficient sequence $\hat{x}(n)$ by multiplying $G^{-1}(u(n)+q(n))$ by the gain g, $G^{-1}(u(n)+q(n))$ being obtained by executing $G^{-1}=\mathrm{sign}(h)\times|h|^{1/a}$, an inverse of the function G, on $u(n)+q(n)$ obtained by adding. That is, $\hat{x}(n)=G^{-1}(u(n)+q(n))\cdot g$. If $a=0.75$, $G^{-1}(h)=\mathrm{sign}(h)\times|h|^{1.33}$.

The present invention is not limited to the embodiment described above, and appropriate changes can be made to the embodiment without departing from the scope of the present invention. Each type of processing described above may be executed not only time sequentially according to the order of description but also in parallel or individually when necessary or according to the processing capabilities of the apparatuses that execute the processing.

When the processing functions of the hardware entities (the encoder 1 and the decoder 2) described above are implemented by a computer, the processing details of the functions that should be provided by the hardware entities are described in a program. When the program is executed by a computer, the processing functions of the hardware entities are implemented on the computer.

The program containing the processing details can be recorded in a computer-readable recording medium. The computer-readable recording medium can be any type of medium, such as a magnetic storage device, an optical disc, a magneto-optical storage medium, or a semiconductor memory. Specifically, for example, a hard disk drive, a flexible disk, a magnetic tape or the like can be used as the magnetic recording device; a DVD (digital versatile disc), DVD-RAM (random access memory), CD-ROM (compact disc read only memory), CD-R/RW (recordable/rewritable), or the like can be used as the optical disc; an MO (magneto-optical disc) or the like can be used as the magneto-optical recording medium; and an EEP-ROM (electronically erasable and programmable read only memory) or the like can be used as the semiconductor memory.

This program is distributed by selling, transferring, or lending a portable recording medium such as a DVD or a CD-ROM with the program recorded on it, for example. The program may also be distributed by storing the program in a storage unit of a server computer and transferring the program from the server computer to another computer through the network.

A computer that executes this type of program first stores the program recorded on the portable recording medium or the program transferred from the server computer in its storage unit. Then, the computer reads the program stored in its storage unit and executes processing in accordance with the read program. In a different program execution form, the computer may read the program directly from the portable recording medium and execute processing in accordance with the program, or the computer may execute processing in accordance with the program each time the computer receives the program transferred from the server computer. Alternatively, the above-described processing may be executed by a so-called application service provider (ASP) service, in which the processing functions are implemented just by giving program execution instructions and obtaining the results without transferring the program from the server computer to the computer. The program of this form includes information that is provided for use in processing by the computer and is treated correspondingly as a program (something that is not a direct instruction to the computer but is data or the like that has characteristics that determine the processing executed by the computer).

In the description given above, the hardware entities are implemented by executing the predetermined program on the computer, but at least a part of the processing may be implemented by hardware.

What is claimed is:

1. A decoding method for decoding an input code formed of a predetermined number of bits, the decoding method comprising:

a decoding step of decoding a variable-length code included in the input code to generate a sequence of integers;

an error decoding step of decoding an error code included in the input code, the error code being formed of a number of surplus bits obtained by subtracting a number of bits of the variable-length code from the predetermined number of bits, to generate a sequence of error values;

a gain decoding step of decoding a gain information included in the input code, to generate a gain;

an adding step of adding each sample value in the sequence of integers to each of the error values and multiplying by the gain to generate a frequency-domain sample sequence used to obtain a speech or acoustic signal, wherein, an error code corresponding to error samples which are among error samples constituting the sequence of error values and whose corresponding integers are not 0 are decoded with priority to obtain the error values in the error decoding step, and each of the error values is a value obtained by adding a positive or negative sign determined by one-bit information in the error code, to an absolute value of a reconstructed value in the error decoding step.

2. The decoding method according to claim 1, wherein, when there is another piece of one-bit information corresponding to each of the samples constituting the sequence of integers, the each of the error values is a value obtained by adding the value obtained by adding the positive or negative sign, to a value obtained by reflecting the positive or negative sign determined by the another piece of one-bit information to half of the absolute value of the reconstructed value in the error decoding step.

3. The decoding method according to claim 1 or 2, wherein a first absolute value of a first reconstructed value obtained when a first integer is not 0 is larger than a second absolute value of a second reconstructed value obtained when a second integer is 0.

4. A decoder configured to decode an input code formed of a predetermined number of bits, the decoder comprising:

processing circuitry configured to perform a decoding step of decoding a variable-length code included in the input code to generate a sequence of integers;

perform an error decoding step of decoding an error code included in the input code, the error code being formed of a number of surplus bits obtained by subtracting a number of bits of the variable-length code from the predetermined number of bits, to generate a sequence of error values;

perform a gain decoding step of decoding a gain information included in the input code, to generate a gain;

perform an adding step of adding each sample value in the sequence of integers to each of the error values and multiplying by the gain to generate a frequency-domain sample sequence used to obtain a speech or acoustic signal, wherein, an error code corresponding to error samples which are among error samples constituting the sequence of error values and whose corresponding integers are not 0 are decoded with priority to obtain the error values in the error decoding step, and each of the error values is a value obtained by adding a positive or negative sign determined by one-bit information in the error code, to an absolute value of a reconstructed value in the error decoding step.

5. The decoder according to claim 4, wherein, when there is another piece of one-bit information corresponding to each of the samples constituting the sequence of integers, the each of the error values is a value obtained by adding the value obtained by adding the positive or negative sign, to a value obtained by reflecting the positive or negative sign determined by the another piece of one-bit information to half of the absolute value of the reconstructed value in the error decoding step.

6. The decoder according to claim 4 or 5, wherein a first absolute value of a first reconstructed value obtained when a first integer is not 0 is larger than a second absolute value of a second reconstructed value obtained when a second integer is 0.

7. A non-transitory computer-readable recording medium having stored thereon a program for causing a computer to execute the steps of the method according to claim 1 or 2.

* * * * *